US005184903A

United States Patent [19]

Smith

[11] Patent Number: 5,184,903

[45] Date of Patent: Feb. 9, 1993

[54] STENOGRAPHIC MACHINE INCLUDING A DISPOSABLE RIBBON CARTRIDGE

[75] Inventor: Gordon W. Smith, San Marcos, Calif.

[73] Assignee: Xscribe Corporation, San Diego, Calif.

[21] Appl. No.: 736,462

[22] Filed: Jul. 26, 1991

[51] Int. Cl.[5] ..... B41J 33/10

[52] U.S. Cl. ..... 400/196.1; 400/91

[58] Field of Search ..... 400/196.1, 91, 92, 93, 400/94, 192, 202, 207, 208

[56] References Cited

U.S. PATENT DOCUMENTS

| | | | |
|---|---|---|---|
| 410,628 | 9/1889 | Anderson | 400/92 |
| 2,246,195 | 6/1941 | Sweeney | 400/202.4 |
| 3,951,253 | 4/1976 | Tibay et al. | 400/202.1 |
| 3,977,512 | 8/1976 | Teagarden et al. | 400/196.1 |
| 4,396,305 | 8/1983 | Shattuck et al. | 400/208 |
| 4,616,942 | 10/1986 | Nagasawa et al. | 400/196.1 |
| 4,712,931 | 12/1987 | Ohshima | 400/196.1 |
| 4,880,323 | 11/1989 | Milliser et al. | 400/196.1 |
| 4,900,170 | 2/1990 | Beck et al. | 400/196.1 |
| 4,913,571 | 4/1990 | Bulson et al. | 400/196.1 |

FOREIGN PATENT DOCUMENTS

| | | | |
|---|---|---|---|
| 0176084 | 5/1984 | Japan | 400/208 |
| 0144380 | 7/1986 | Japan | 400/208 |

*Primary Examiner*—David A. Wiecking
*Assistant Examiner*—Anthony H. Nguyen
*Attorney, Agent, or Firm*—Graham & James

[57] ABSTRACT

A compact and disposable stenographic ribbon cartridge system includes a cartridge driven by an external drive. The cartridge contains a densely-packed ribbon that is automatically inked. Under urging of the drive, the ribbon travels through an external guide that holds the ribbon between the character trunnion and the paper platen. A sealed ink reservoir is disposed above the ribbon chamber. The ribbon is pulled by an idler gear and a drive gear. The idler gear is in contact with a wick extending from the reservoir. As the idler gear rotates, it wicks the ink onto itself and transfers the ink to the ribbon as it makes contact. The external drive system is coupled to the platen so as to cause movement of the ribbon upon movement of the platen.

15 Claims, 7 Drawing Sheets

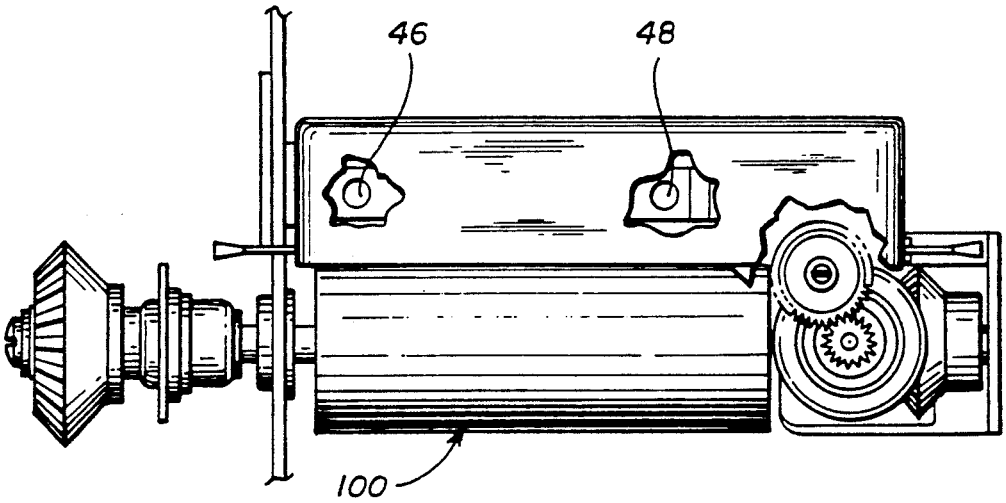
FIG. 9
FIG. 10
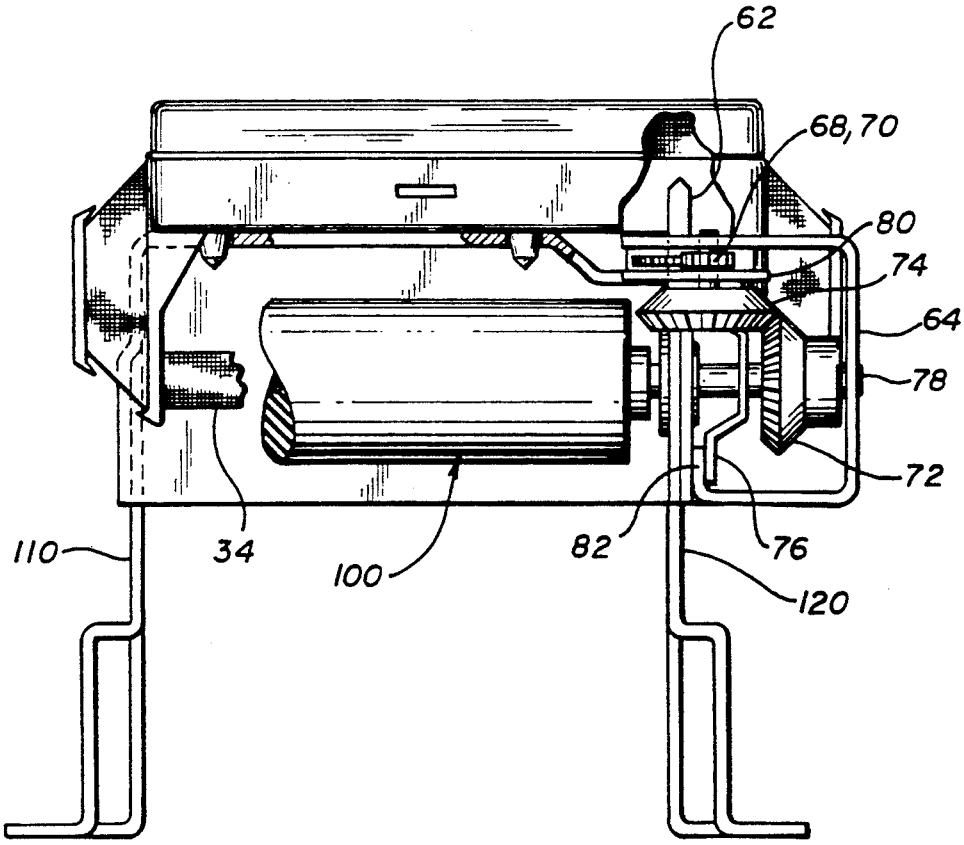

STENOGRAPHIC MACHINE INCLUDING A DISPOSABLE RIBBON CARTRIDGE

FIELD OF THE INVENTION

The present invention relates generally to stenographic machines and, in particular, relates to ribbon mechanisms used in such machines.

BACKGROUND OF THE INVENTION

The basic stenographic machine mechanism today used by court reporters has changed little since the invention of the machine over 40 years ago. The basic stenographic machine is shown in a variety of patents. See, for example, U.S. Pat. Nos. 2,319,273, 2,387,330, 2,392,078, and 2,292,781. Modern stenographic machines have adapted the basic mechanism to digital computer technology through the addition of such items as floppy disk drives, random access computer memories, internal modems and the like. Despite the addition of such technological, the basic mechanical mechanism remains essentially intact.

One of the mechanical holdovers of the basic stenographic mechanism is the ribbon and inking mechanism. To this day, virtually all stenographic machines, whether augmented with computer technology or not, still use a roll of ribbon attached to small spools, much like that of an old manual typewriter. The ribbon travels back and forth and must be continually re-inked by the reporter, usually with a small bottle of ink carried by the reporter.

Manual re-inking of the ribbon is messy, particularly in view of the permanent ink that must be used. It also requires that the reporter carry an ink bottle that is subject to leaking. Furthermore, a reporter's stopping of a deposition or the like in order to re-ink the machine is a distraction and a disruption of the proceedings. What is more, changing of the ribbon and insertion of a new ribbon also typically involves getting ink on the reporter's hands, and occasionally his or her clothes, which is obviously undesirable.

One way to alleviate these problems is through the use of ribbon cartridges. Two United States patents have previously been issued for ribbon cartridges for stenographic machines. These patents are: U.S. Pat. No. 4,469,456, issued to Fitzgerald on Sep. 4, 1984 and entitled "Disposable Ribbon Carrier for a Stenograph Reporting Machine," and U.S. Pat. No. 4,289,413, issued to Seplin on Sep. 15, 1981 and entitled "Cartridge and Ribbon for use with a Single Spool Stenotype Machine." The '413 patent also identifies other types of ribbon cartridges that have been designed for various non-stenographic printing applications. These two prior patents, which discuss in more detail the need for a ribbon cartridge, nevertheless fail to provide a satisfactory mechanism. In particular, these patents disclose little more than a shroud around the standard ribbon and ribbon spool. If the ribbon is low on ink, then it must be re-inked in a manner similar to the standard ribbon.

Accordingly, it is an object of the invention to eliminate typewriter-style ribbons in stenographic machines.

It is a further object of the invention to eliminate manual re-inking of ribbons in stenographic machines.

Yet another object of the invention is to allow a ribbon to be quickly changed in a stenographic machine.

A further object of the invention is to simplify the construction of ribbon cartridges for stenographic machines.

SUMMARY OF THE INVENTION

The present invention, in a broad aspect, is a ribbon cartridge system mounted on the stenographic machine above the platen. The system includes a self-inking cartridge and a drive mechanism. The cartridge contains an endless loop of ribbon that is stacked in a chamber. No ribbon spools are used. The ribbon is driven by the external drive. Under urging of the drive, the ribbon travels though an external guide that holds the ribbon between the character trunnion and the paper platen. The ribbon randomly folds back into the ribbon chamber after it has travelled past the character trunnion.

In accordance with one feature of the invention, the ribbon fabric is inked from a sealed ink reservoir disposed within the cartridge above the ribbon chamber. The ribbon is pinched between and pulled by an idler gear and a drive gear, which is itself driven by the external drive. The idler gear is in contact with a wick extending from the reservoir. As the idler gear rotates, it wicks the ink onto itself and transfers the ink to the ribbon as it comes in contact with the ribbon being pulled through the ribbon chamber. The ribbon reservoir contains a felt pad that a high saturation level and which is saturated with ink.

In accordance with yet another feature of the invention, the cartridge drive system is coupled via a compact gearbox to the platen of the stenographic machine. Movement of the platen thus causes movement of the ribbon.

Other objects, features, and advantages of the present invention will become apparent from a consideration of the following detail description and of the accompanying drawings.

BRIEF DESCRIPTION OF THE DRAWINGS

FIG. 9 shows a front view, partially in cross-section, of the ribbon cartridge and drive system according to the present invention; and FIG. 10 shows a top view, partially in cross-section, of the ribbon cartridge and drive system according to the present invention.

DETAILED DESCRIPTION

Figure 1:
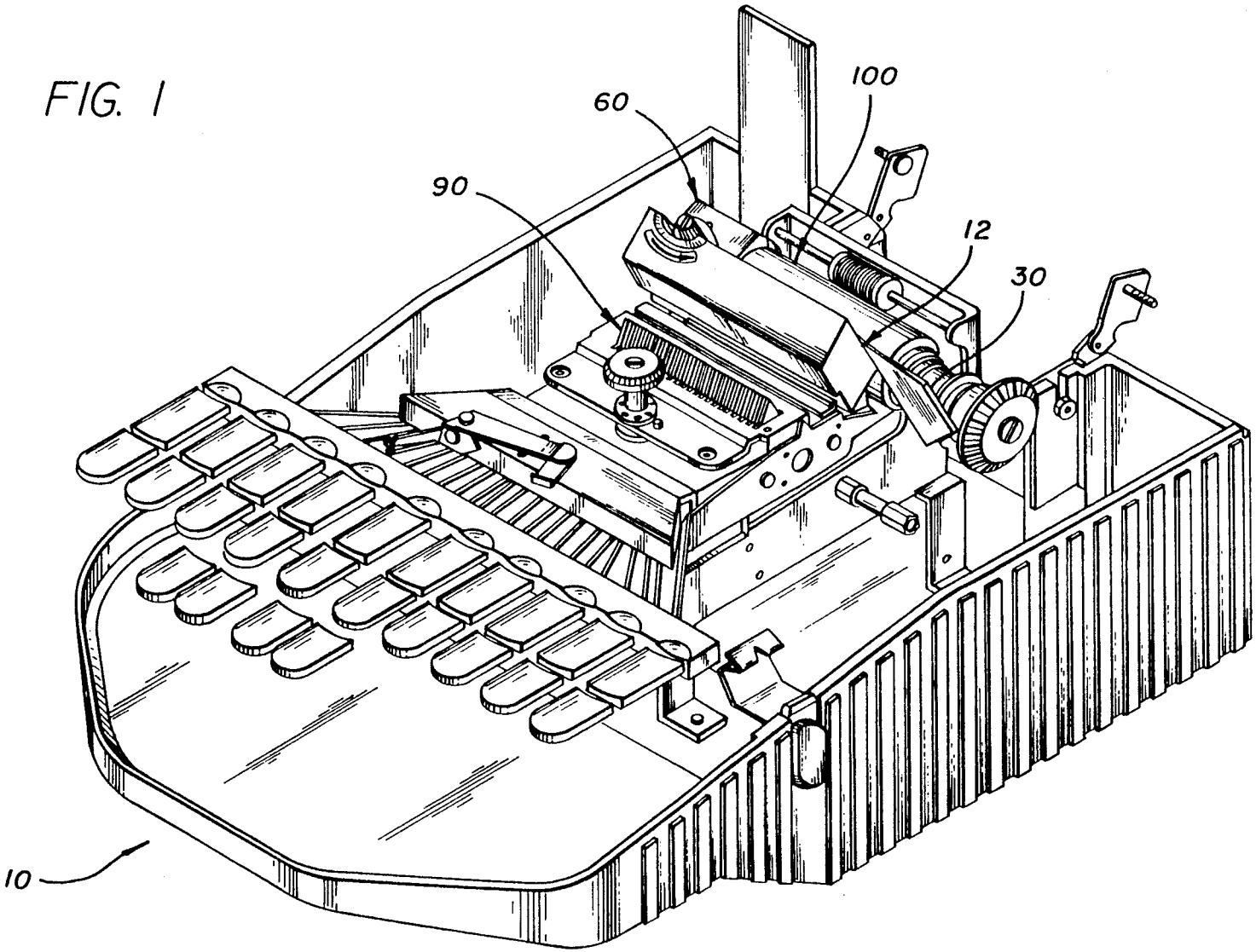
FIG. 1 shows a detailed perspective view of a stenographic machine incorporating a ribbon cartridge system according to the present invention.

Turning more particularly to the drawings, FIG. 1 shows a perspective view of a stenographic machine 10 incorporating a ribbon cartridge assembly 12 according to the present invention. The stenographic machine shown in FIG. 10 is typical of many of the modern stenographic machines that incorporate the basic stenographic machine mechanism that has been made for many years. The ribbon cartridge assembly 12 is designed to replace the ribbon spools found in the prior art.

Figure 2:
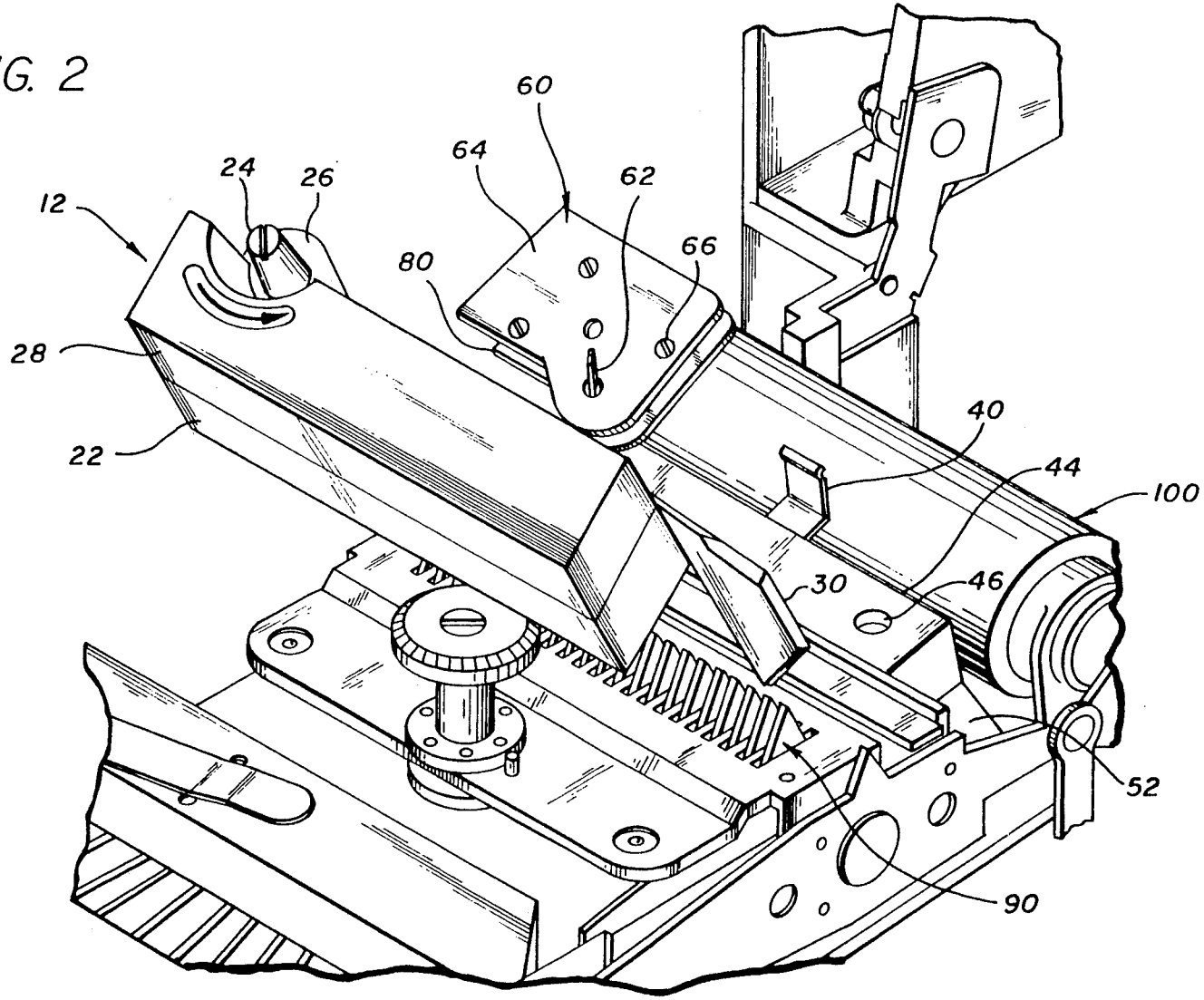
FIG. 2 is a view similar to FIG. 1, but showing the ribbon cartridge just prior to the attachment of the cartridge to the machine.
Figure 3:
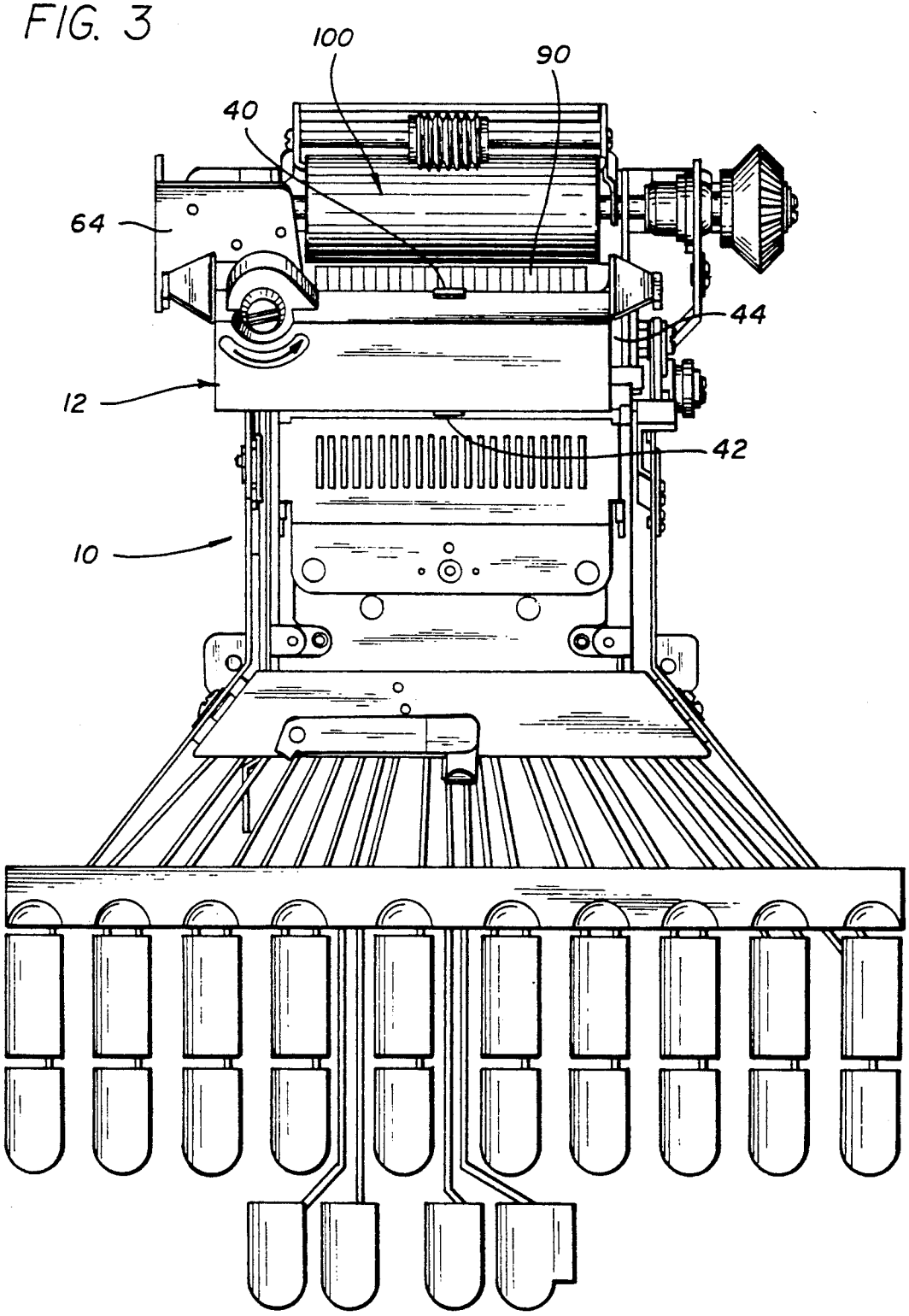
FIG. 3 shows a top view of a stenographic machine incorporating the ribbon cartridge system according to the present invention.

As reflected in FIG. 2, the two basic portions of the present invention are the ribbon cartridge assembly 12 and the external drive assembly 60. The ribbon cartridge assembly 12 clips on to a cartridge bracket 44 and is held thereto by a clip having a front portion and a back portion 40/42. In the installed position, as reflected in FIG. 1, the cartridge assembly 12 places a ribbon 38 between the paper platen 100 and the trunnion assembly 90.

Figure 4:
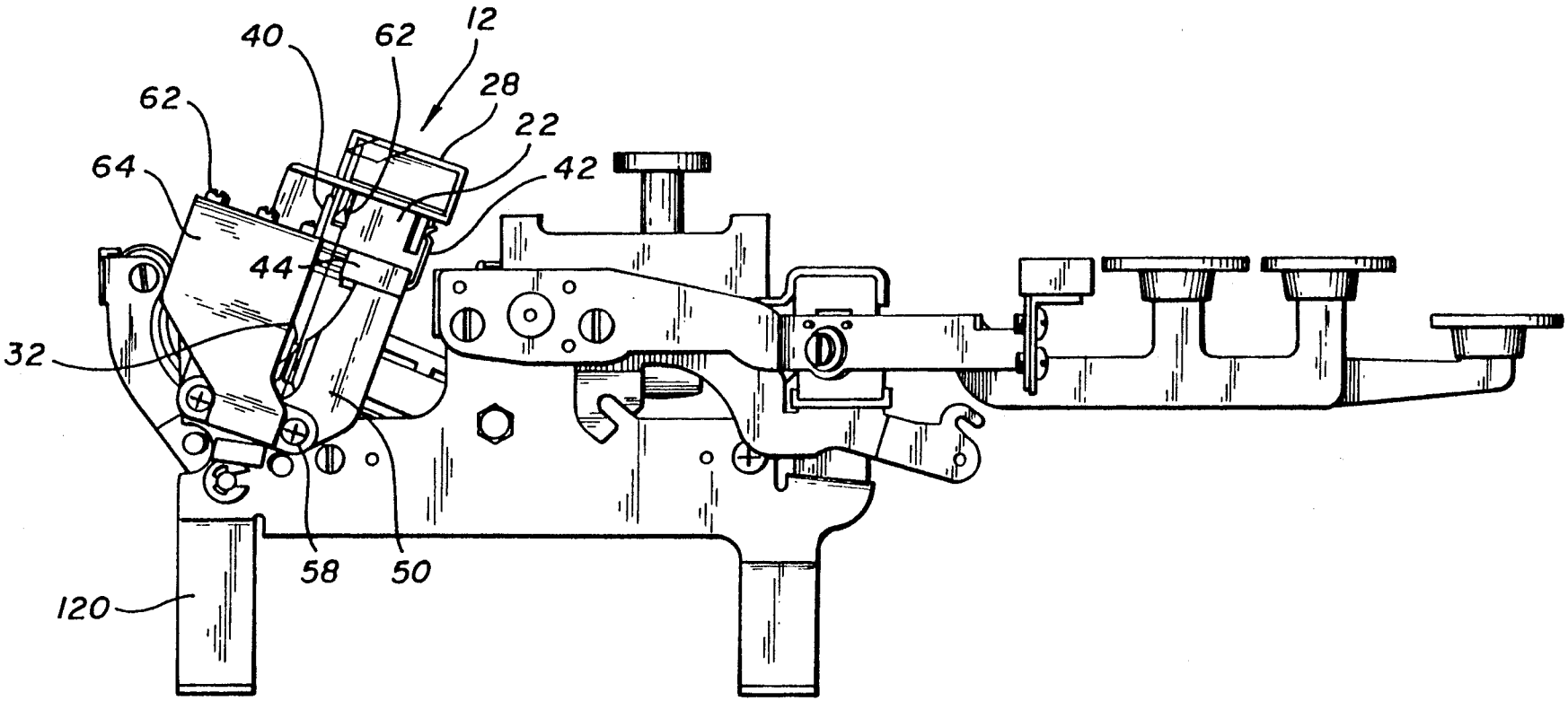
FIG. 4 shows a left view of the stenographic machine of FIG. 3.
Figure 5:
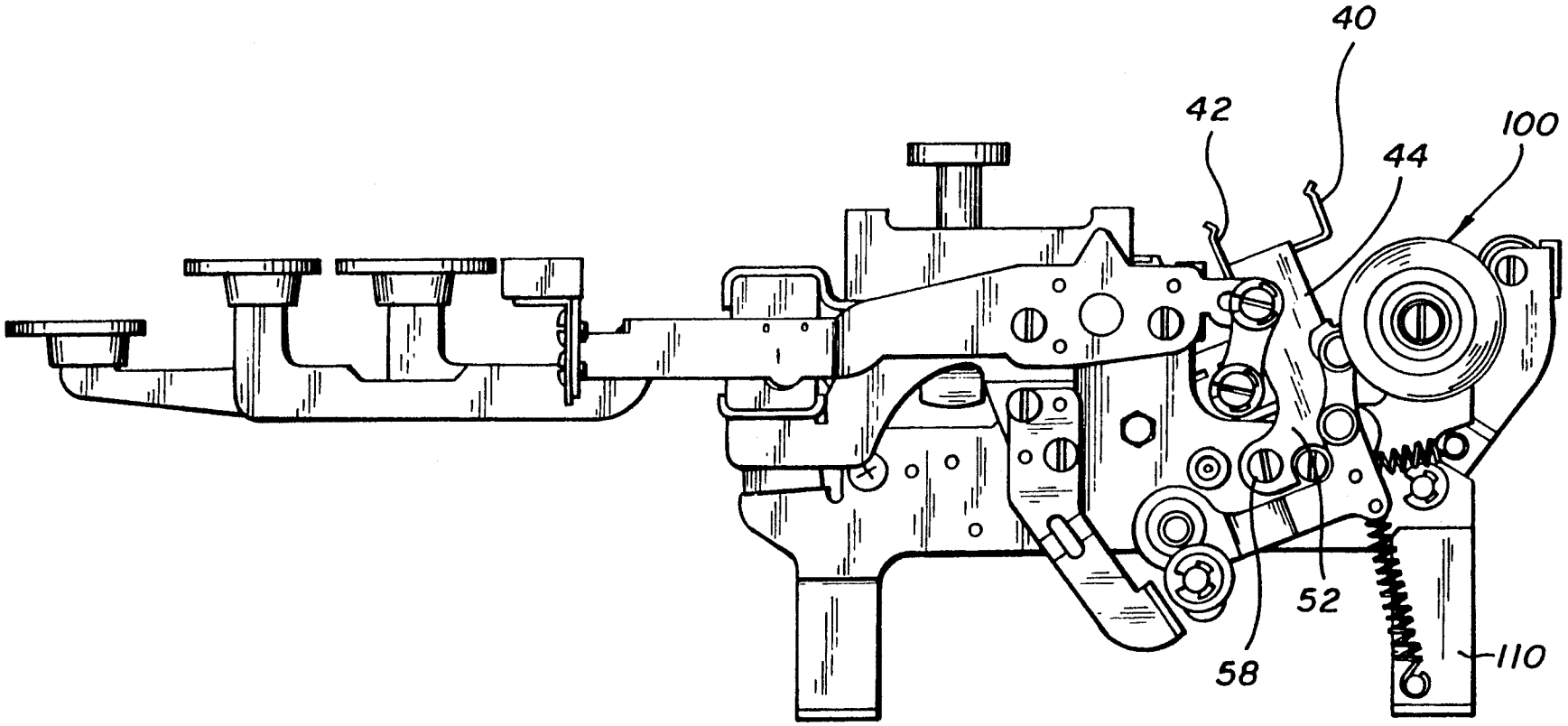
FIG. 5 shows a right view of the stenographic machine of FIG. 3.

The cartridge bracket 44 has a bracket left leg 50, as shown in more detail in FIG. 4 and a right leg 52, shown in more detail in FIG. 5. These legs are mounted to the right and left frame pieces 110 and 120 by screws 56 and 58, respectively.

Figure 8:
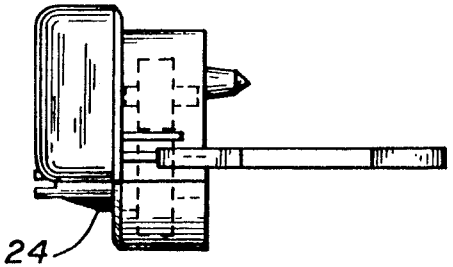
FIG. 8 shows a cross-sectional view, taken through the plane VIII—VIII of the ribbon cartridge shown in FIG. 6.
Figure 6:
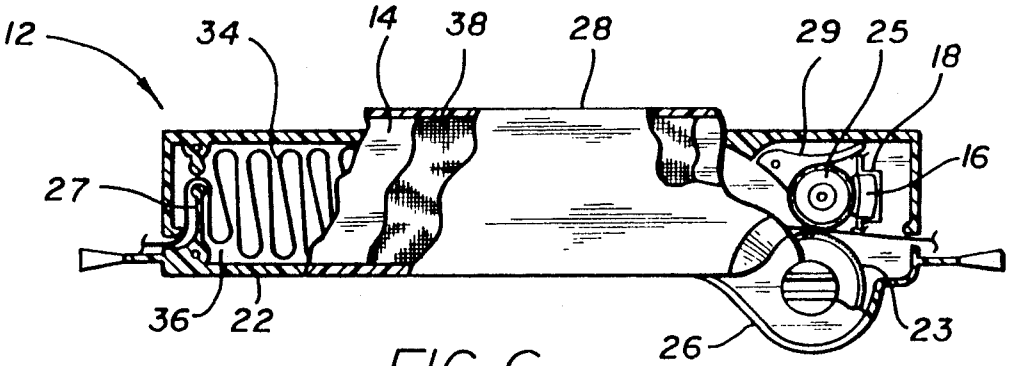
FIG. 6 shows a top view, partially in cross-section, of the ribbon cartridge system according to the present invention.
Figure 7:
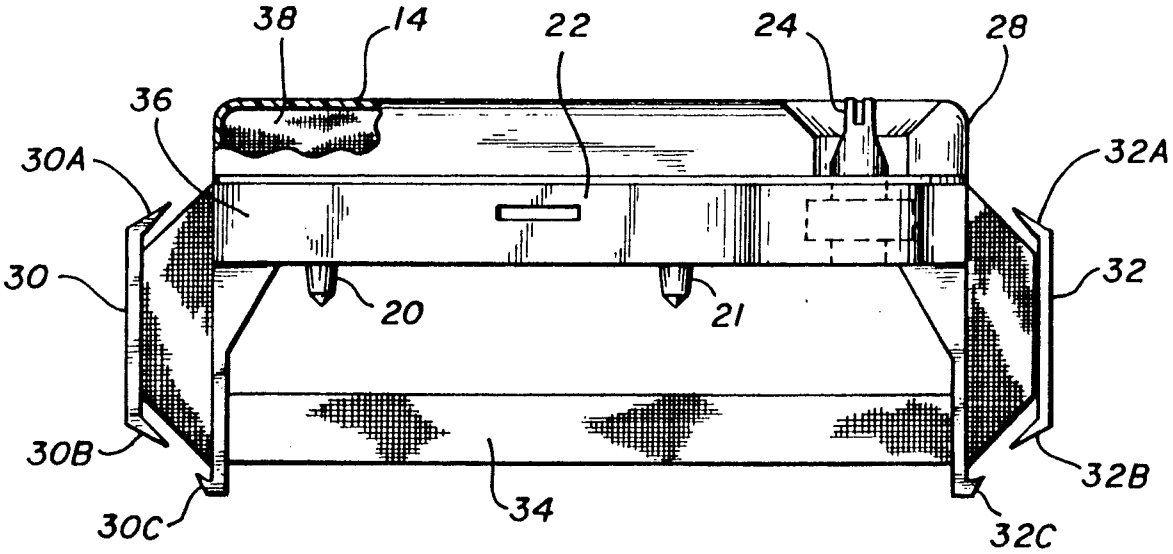
FIG. 7 shows a front view of the ribbon cartridge according to the present invention.

The cartridge itself is shown in more detail in FIGS. 6–8. The cartridge assembly 12 has two guide pins 20 and 21 that engage guide holes 46 and 48 on the cartridge to ensure proper mounting. The cartridge assembly 12 includes an upper housing 28 and a lower housing 22. The lower housing 22 contains a ribbon 34 and a ribbon chamber 36. The ribbon preferably is approximately 72 inches long and is fully contained within the chamber. The ribbon exits the chamber at its lower portion and passes over left and right ribbon guides 32 and 30 so as to end up between the trunnion assembly 90 and the platen assembly 100. The left and right ribbon guides 30 and 32 are provided with guide members 30(*a*)(*b*)(*c*) and 32(*a*)(*b*)(*c*) to maintain the ribbon 34 within the channels, as shown more particularly in FIG. 7. As can be appreciated, the present invention does not require any ribbon spools.

Contained in the upper housing 28 is a chamber 14 containing a felt 38 that is saturated with ink. The felt pad is designed to have a high saturation level. A wick 16 in a wick chamber 18 extends from the upper housing into the ribbon chamber 36. The wick 16 rests against an idler gear 25 in the lower housing 22. The ribbon 34 in the ribbon chamber 36 follows a path around a ribbon tension spring 27 as well as the idler gear holder with an integral molded spring 28. The ribbon 34 passes between the idler gear 25 and the ribbon drive gear 23, which is mounted within a housing 26 protruding from the lower housing 22.

The wick 16 rests against the idler gear 25. As the idler gear 25 rotates, it wicks the ink onto itself and transfers the ink to the ribbon 34 as it comes in contact with the ribbon as it is pulled through the ribbon chamber 36 under urging of the ribbon drive gear 23.

As shown in FIG. 2, a drive shaft 62 extends from the drive gear assembly 60 that engages the ribbon drive gear 23. As the ribbon drive gear 23 is turned by the drive shaft 62, the ribbon 34 is pulled through the cartridge and is continually inked. Once the felt 38 in the felt chamber 14 is depleted of ink, the entire ribbon cartridge assembly 12 is disposed of a new ribbon cartridge is inserted. The drive gear 23 has an extension 24 to allow the ribbon to be tensioned prior to installation into the stenographic machine 10.

The ribbon width is preferably on the order of 0.3035 to 0.3215 inches. The weave is a high density-high tenacity endless loop. The caliper of the fabric is preferably 0.0045 to 0.0051. As stated, the length of the ribbon in yards is approximately 1.57 to 1.66 yards. The ribbon is packed into the lower housing 22 by simply stuffing the ribbon therein during the manufacturing process. Since the ribbon fabric is a continuous loop, it randomly folds within the ribbon chamber 36 as it is being driven.

The upper and lower housing halves 22 and 28 may be sealed by means known in the arts such as ultrasonic, snap-fit, or the like. The advance of the ribbon is preferably 1.5 inches per revolution. The external tension of the ribbon is preferably is 8–10 grams.

The ribbon drive assembly, to be discussed in more detail below, preferably has a starting torque on the ribbon cartridge of approximately 1.5 in oz. The maximum drive torque in the run mode is 0.8 in oz., with a minimum drive pull of 5 grams.

Turning now to the ribbon drive system 60, the drive system is shown in detail in FIGS. 9 and 10. The drive assembly 60 includes a shaft 78 attached to the platen assembly 100. The shaft 78 is supported with a bracket 76 that is attached to the left frame 120 via a screw 130 and spacers 82. At the distal end of the shaft is a gearbox. The gearbox includes a pinion gear 72. The pinion gear 72 drives a second pinion gear 74 that is supported on a plate 80 which is affixed by screws 66 to a U-shaped support bracket 64. As reflected in FIG. 4, the support bracket 62 is likewise attached by screws to the left frame 120. Sandwiched between the lower side of the support bracket 64 and the upper side of the plate 80 are two transmission gears 68 and 70. The innermost gear 68 supports the drive shaft 62 that engages the ribbon drive gear 23 within the ribbon cartridge assembly 12.

The effect of the two pinion gears 70 and 74 and the smaller transmission gears 68 and 72 is to take the circular motion of the platen 100, which rotates about a horizontal axis and to change that motion to rotation about a generally vertical axis so as to enable the ribbon cartridge assembly 12 to be powered by the platen.

As can now be appreciated from the foregoing description, operation of the stenographic machine 10 causes movement of the platen assembly 100. As a result, the drive shaft 62 in the drive gear assembly 60, which engages the ribbon drive gear 23 in the ribbon cartridge assembly 12, causes rotation of the ribbon drive gear 23. This, in turn, causes movement of the ribbon 34, which is pinched between the drive gear 23 and the idler gear 25. The ribbon fabric is thus pulled from the ribbon chamber 36 and across the character trunnion assembly 90 under support of the ribbon guides 30 and 32. Since the ribbon fabric is a continuous loop, it randomly folds within the ribbon chamber 36 as it is being driven. The ribbon is continually re-inked by means of the wick 16.

As can be appreciated from the foregoing, the problems posed by the ribbon spools, as well as the ribbon cartridges, in the prior art are eliminated with the present invention. Once the ribbon cartridge is depleted of ink, it is simply discarded and a new ribbon is snapped into place. The ribbon cartridges are small and compact and several may be carried by the court reporter.

From the foregoing description of the present invention, a preferred embodiment of the invention has been disclosed and described in detail. It is to be understood that other mechanical and design variations are within the scope of the present invention. Thus, by way of example, not of limitation, the arrangement of the drive gear and idler gear could be different. The housing could be formed of a single part rather than of two parts. The ribbon could be supported differently than as shown in the figures. The drive gear assembly could be oriented differently to take advantage of movement of the platen. Accordingly, the present invention is not limited to the particular embodiment which has been described in detail herein.

What is claimed is:

1. A stenographic machine of the type having a character trunnion, a paper platen and an inked-ribbon, comprising:

self-inking ribbon cartridge means including a housing having a chamber for circulating an endless ribbon between said trunnion and said platen in an alignment generally perpendicular to a first generally horizontal plane which bisects the paper platen, and means for containing the remainder of said endless ribbon in said chamber of said housing with said ribbon aligned generally perpendicular to a second generally horizontal plane, said first and second horizontal planes being spaced apart vertically: and first and second guide means affixed to and integral with said cartridge means, said first guide means extending between said first and second generally horizontal planes for guiding and directing said endless ribbon vertically from said chamber of said housing to said position between said trunnion and said platen, and said second guide means extending between said first and second generally horizontal planes for guiding and returning said ribbon to said chamber.

2. A system as defined in claim 1, wherein said system further comprises:

drive means, coupled to said platen, for causing movement of said ribbon contemporaneously with movement of said platen.

3. A system as defined in claim 1, wherein said cartridge means comprises:

a housing:

ribbon chamber means, disposed in said housing, for storing said ribbon;

sealed ink reservoir means, disposed in said housing, for storing a supply of ink; and wick means, communicating with said ribbon chamber means and said ink reservoir means, for transferring ink from said ink reservoir means to said ribbon.

4. A system as defined in claim 3, wherein said cartridge means further comprises:

tensioning means for tensioning said ribbon;

drive means for pulling said ribbon through said cartridge means; and guide means, attached to said housing, for directing said ribbon out of and back into said housing and for supporting said ribbon in an exposed position between said character trunnion and said platen.

5. A system as defined in claim 4, wherein said tensioning means comprises:

spring means, disposed in said ribbon chamber means, for automatically tensioning said ribbon; and shaft means, coupled to said drive means, for manually tensioning said ribbon.

6. A system as defined in claim 4, wherein said drive means comprises:

a drive gear disposed in said ribbon chamber means and coupled to said platen;

an idler gear disposed in said ribbon chamber means adjacent said drive gear to cause said ribbon to be pinched between said drive gear and said idler gear, whereby rotation of said platen causes rotation of said drive gear and movement of said ribbon.

7. A system as defined in claim 6, wherein:

said ink reservoir means comprises a pad saturated with ink;

said wick means comprises a wick in fluid communication with said pad and said idler gear, whereby rotation of said drive gear causes rotation of said idler gear against said wick and ink is transferred from said wick to said ribbon via said idler gear as said ribbon is pulled through said ribbon chamber means.

8. A system as defined in claim 2, wherein said drive means comprises:

drive shaft means for engaging said cartridge means; and gearbox means for transferring rotational movement of said platen to said drive shaft means.

9. A system as defined in claim 8, wherein said gearbox means comprises:

a shaft engaging said platen for rotation about a horizontal axis;

pinion gear means, coupled to said shaft, for producing rotation about a generally vertical axis; and transmission gear means, coupled between said drive shaft means and said pinion gear means, whereby rotation of said platen about said horizontal axis causes rotation of said drive shaft means about said generally vertical axis.

10. A system as defined in claim 1, wherein said system further comprises:

bracket means, attached to said stenograph machine, for supporting said cartridge means above said trunnion and adjacent said platen.

11. A ribbon cartridge system adapted for use in a stenographic machine of the type having a character trunnion and a paper platen, said ribbon cartridge system comprising:

disposable ribbon cartrige means including a housing having a chamber, mounted above said trunnion and adjacent said platen, including means for storing a major portion of an endless ribbon in said chamber of said housing with said ribbon aligned generally perpendicular to an upper generally horizontal plane, and means for circulating said endless ribbon between said trunnion and said platen in an alignment generally perpendicular to a lower generally horizontal plane which bisects the paper platen, said upper and lower horizontal planes being spaced apart vertically;

first and second guide means affixed to an integral with said cartridge means, said first guide means extending between said upper and lower generally horizontal planes for guiding and directing said endless ribbon vertically from said chamber of said housing to said position between said trunnion and said platen, and said second guide means again for guiding and returning said ribbon to said chamber; and drive means, coupled to said platen, for causing movement of said ribbon contemporaneously with movement of said platen.

12. A system as defined in claim 11, wherein said cartridge means further comprises:

self-inking means for transferring ink to said ribbon.

13. A system as defined in claim 12, wherein said self-inking means comprises:

sealed ink reservoir means for storing a supply of ink; and wick means, communicating with ink reservoir means, for transferring ink from said ink reservoir means to said ribbon.

14. A system as defined in claim 11, wherein said cartridge means further comprises:

guide means, attached to said cartridge means, for supporting said ribbon in an exposed position between said character trunnion and said platen; and a drive gear, disposed in said cartridge means, for engaging said ribbon.

15. A system as defined in claim 14, wherein said drive means comprises:

a drive shaft engaging said drive gear;

gearbox means, coupled between said platen and said drive shaft, for transferring rotational movement of said platen to said drive shaft, whereby rotation of said platen causes movement of said ribbon.

* * * * *